US006328405B1

(12) United States Patent
Weber et al.

(10) Patent No.: US 6,328,405 B1
(45) Date of Patent: Dec. 11, 2001

(54) PRINTHEAD COMPRISING MULTIPLE TYPES OF DROP GENERATORS

(75) Inventors: Timothy L. Weber; John Stephen Dunfield, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/539,298

(22) Filed: Mar. 30, 2000

(51) Int. Cl.[7] ..... B41J 2/205
(52) U.S. Cl. ..... 347/15
(58) Field of Search ..... 347/15, 12, 13, 347/40, 212, 43, 26, 87

(56) References Cited

U.S. PATENT DOCUMENTS

| | | | | |
|---|---|---|---|---|
| 5,187,500 | | 2/1993 | Bohorquez et al. . | |
| 5,473,351 | | 12/1995 | Helterline et al. | 347/19 |
| 5,521,622 | * | 5/1996 | Hock et al. | 347/43 |
| 6,183,076 | * | 2/2001 | Childers et al. | 347/86 |

FOREIGN PATENT DOCUMENTS

| | | | | |
|---|---|---|---|---|
| 361104856-A | * | 5/1986 | (JP) . | |
| 406008475-A | * | 1/1994 | (JP) | 347/43 |

* cited by examiner

*Primary Examiner*—John Barlow
*Assistant Examiner*—Michael S Brooke

(57) ABSTRACT

A printhead includes at least a first drop generator set and at least a second drop generator set. The first drop generator set includes a first type of drop generator, whereas the other drop generator sets include a second type of drop generator. The first and second types of drop generators are primarily different with regard to the drop weights they are capable of providing. Preferably, the first type of drop generator comprises a multi-nozzle configuration, whereas the second type comprises single nozzle configurations. In one embodiment, a first type of ink is ejected by the first type of drop generators and a second type of ink is ejected by the second type of drop generators. To prevent unwanted mixing of the black and color inks, a first orifice or nozzle layer is provided separate and apart from a second orifice layer. In this manner, a single printhead may be used for the delivery of both black and color inks.

34 Claims, 4 Drawing Sheets

PRINTHEAD COMPRISING MULTIPLE TYPES OF DROP GENERATORS

CROSS-REFERENCE TO RELATED APPLICATIONS

Related subject matter is disclosed in U.S. patent application Ser. No. 09/300,785 entitled IMPROVED PRINTER PRINTHEAD filed on Apr. 27, 1999, and assigned to the same assignee as the present invention (docket number 10970795-1), the teachings of which are incorporated herein by this reference.

TECHNICAL FIELD

The present invention relates generally to inkjet printers and, in particular, to a printhead comprising multiple types of drop generators.

BACKGROUND OF THE INVENTION

Inkjet printers are well known in the art. A typical inkjet printhead comprises a silicon substrate, structures built on the substrate, and connections to the substrate to provide an array of drop generators. Such a printhead typically uses liquid ink (i.e., dissolved colorants or pigments dispersed in a solvent). Each drop generator comprises a precisely formed orifice or nozzle attached to the substrate that incorporates an ink ejection chamber that receives liquid ink from an ink reservoir. Each chamber is located opposite a nozzle so ink can collect between it and the nozzle. The ejection of ink droplets is typically under the control of a microprocessor, the signals of which are conveyed by electrical traces to ink ejectors (typically, resistor elements) on the substrate. When electric printing pulses activate the ink ejectors (i.e., heat a resistor element), a small portion of the ink next to it vaporizes and ejects a drop of ink from the printhead. Properly arranged drop generators form a dot matrix pattern. Properly sequencing the operation of each drop generator causes characters or images to be printed upon paper as the printhead moves past the paper.

Given current manufacturing technology, drop generators provided on silicon-based printheads of the type described above are currently capable of producing only a single drop weight. That is, the characteristics of each drop generator (i.e., chamber volume, orifice layer thickness, etc.) on a printhead are essentially identical. As a result, the drop weight or drop volume provided by each drop generator will be substantially identical. Furthermore, different types of inks have different dot gains, i.e., the amount of coverage provided for an equivalent ink drop volume. For example, different ink colors typically required different drop weights to produce equivalent amounts of coverage. In particular, black inks generally require a drop weight about twice that of color inks in that they have much different spreading characteristics to achieve substantially equal pixel coverage.

Given these circumstances, it is not currently possible to combine black and color architectures on a single printhead. One possible solution to this problem would be to provide equivalent drop generator structures for black and color inks and activate the black drop generators more frequently (i.e., twice as often) than the color drop generators, thereby providing similar coverage. However, this approach would effectively halve the expected reliability of black drop generators relative to color. Thus, the current approach to combine color and black inks in a single printer is to provide multiple print cartridges; one for each color (typically: cyan, yellow and magenta) and one for black. While this approach works, a cost and competitive advantage would be provided if black and color architectures could be combined into a single printhead and, therefore, a single cartridge.

SUMMARY OF THE INVENTION

The present invention provides a printhead having multiple types of drop generators, which types are differentiated according to at least the respective drop weights provided by each. Preferably, a first type of drop generator comprises at least two nozzles, whereas a second type of drop generator comprises a single nozzle. For the first type of drop generator, at least one ink ejector is associated with the at least two nozzles, which at least one ink ejector is controlled by a single firing signal. Preferably, each nozzle of the first type of drop generator has a uniquely corresponding ink ejector. In one embodiment of the invention, the first type of drop generators ejects a first type of ink and the second type of drop generators ejects a second type of ink. Preferably, the first type of ink is black ink and the second type of ink is color ink, such as cyan, yellow or magenta ink. Sets of drop generators are provided comprising both the first type and at least the second type. To prevent unwanted mixing of the black and color inks, a first orifice layer is provided separate and apart from a second orifice layer. The first and second orifice layers respectively define at least a first set of drop generators of the first type and at least a second set of drop generators of the second type. In this manner, a single printhead may be used for the delivery of both black and color inks. The printhead of the present invention may be provided as part of an inkjet cartridge and/or printing apparatus, thereby providing a competitive advantage over prior art devices.

DETAILED DESCRIPTION OF THE INVENTION

Figure 1:
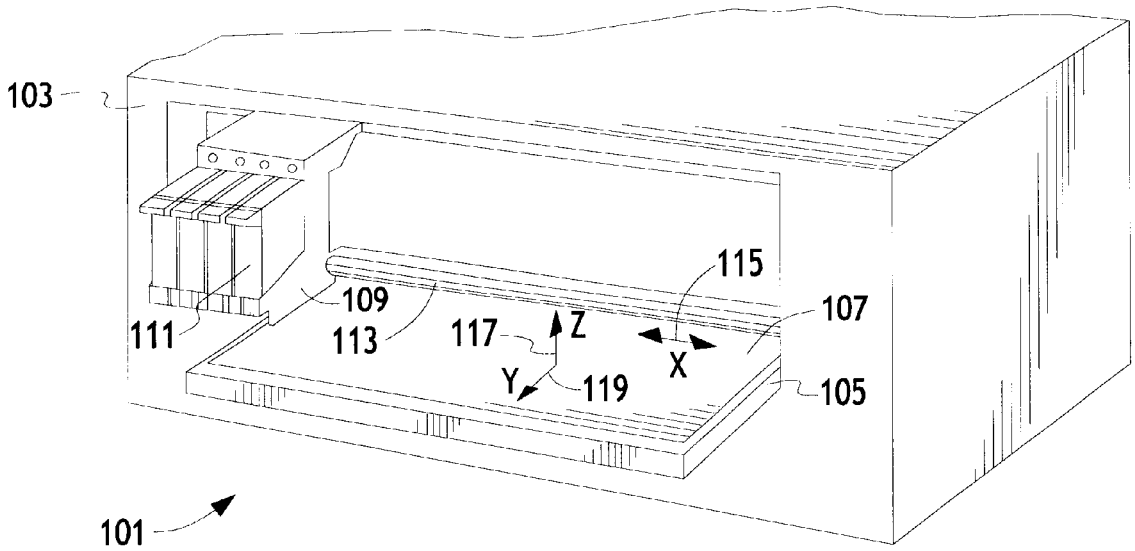
FIG. 1 illustrates a perspective view (partial cut-away) of an inkjet printing apparatus (cover panel removed) in which the present invention may be incorporated.

The present invention may be more fully described with reference to FIGS. 1–7. An exemplary inkjet printer 101 is shown in rudimentary form in FIG. 1. A printer housing 103 contains a platen 105 to which input print media 107 is transported by mechanisms that are known in the art. A carriage 109 holds a set of individual print cartridges, e.g. 111. In a preferred embodiment, a single ink cartridge is capable of providing various colors of ink, e.g., cyan ink, magenta ink, yellow ink, and black ink, it being recognized that other ink colors are possible and not precluded from use by the present invention. Further alternative embodiments can include semi-permanent printhead mechanisms having at least one small volume, on-board, ink chamber that is sporadically replenished from fluidically-coupled, off-axis, ink reservoirs or print cartridges having two or more colors of ink available within the print cartridge and ink ejecting nozzles specifically designated for each color; the present invention is applicable to inkjet cartridges of any of the alternatives. The cartridge 109 is typically mounted on a slide bar 113, allowing the carriage 109 to be scanned back and forth across the print media 107. The scan axis, "X," is indicated by arrow 115. As the carriage 109 scans, ink drops are selectively ejected from the set of print cartridges onto the media 107 in predetermined print swath patterns, forming images or alphanumeric characters using dot matrix manipulation. Generally, the dot matrix manipulation is determined by an external computer (not shown) and instructions are conventionally transmitted to a microprocessor-based electronic controller (not shown) within the printer 101. The ink drop trajectory axis, "Z," is indicated by arrow 117. When a swath of print has been completed, the media 107 is moved an appropriate distance along the print media axis, "Y," indicated by arrow 119 in preparation for the printing of the next swath.

Figure 2:
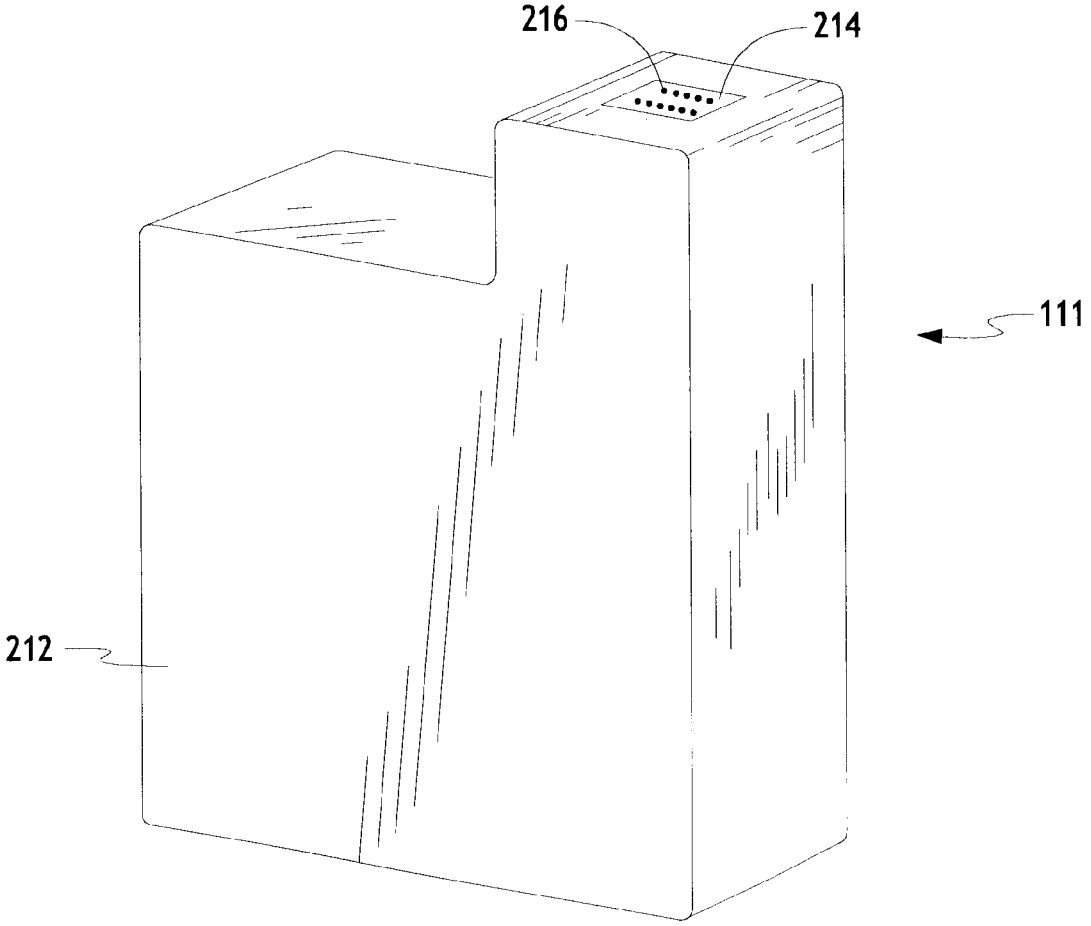
FIG. 2 illustrates an isometric view of an inkjet cartridge component of FIG. 1.

An exemplary thermal inkjet cartridge 111 is shown in FIG. 2. A cartridge housing, or shell, 212 contains at least one internal reservoir of ink (not shown). In a preferred embodiment, a single cartridge comprises multiple internal ink reservoirs for multiple ink colors, e.g., cyan, yellow, magenta and black. The cartridge is provided with a printhead 214, that includes an orifice plate 216, having a plurality of miniature nozzles constructed in combination with subjacent firing chambers and ink ejector structures to provide respective drop generators, and electrical contacts for coupling to the printer 101. Related sets of drop generators taken together form a printhead array. Note that the printhead array illustrated in FIG. 2 is for the purpose of illustrating the structure of an inkjet cartridge only and is not necessarily representative of a printhead array in accordance with the present invention. A printhead in accordance with the present invention is illustrated in FIG. 3.

Figure 3:
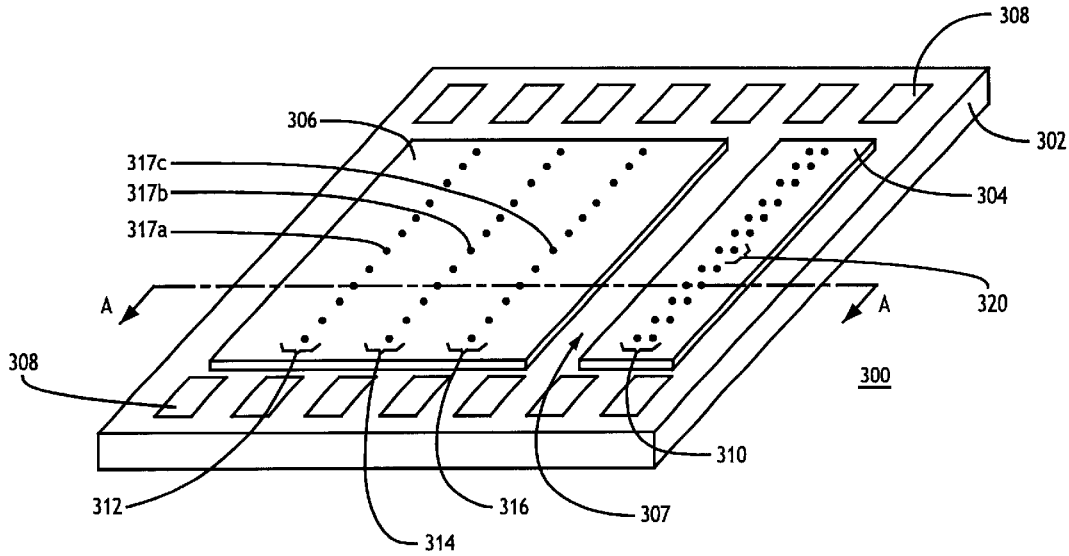
FIG. 3 illustrates an enlarged perspective view of a printhead in accordance with the present invention.

Referring now to FIG. 3, it can be seen that the printhead 300 comprises a silicon substrate 302, with a first orifice layer 304 and second orifice layer 306 supported thereby. Note that the printhead 300 is not shown to scale. In practice, the first and second orifice layers 304, 306 rest upon and are joined to a support layer (not shown), which support layer is described in greater detail below. The substrate preferably has a thickness in accordance with industry standards, typically 675 $\mu$m. Each orifice layer 304, 306 is preferably formed using a polymer with a spin-on, laminated, or extruded polymer thinfilm process having a thickness of about 10–30 $\mu$m. Any suitable photoimagable polymer film may be used, for example, polyamide, polymethylmethacrylate, polycarbonate, polyester, polyamide, polyethalene-terephthalate or mixtures thereof Alternatively, the orifice layers may be formed of a metal-plated member or ceramics such as the oxides of silicon manufactured by conventional electrodeposition techniques. A plurality of electrically conductive signal connection pads 308 are also provided. As known in the art, the connection pads 308 couple electrical signals from an electronic controller for controlling the operation of individual drop generators.

A first set of drop generators 310 comprising a first type of drop generator 320 is shown. The first set of drop generators 310 is defined in part by the first orifice layer 304. In a similar fashion, a second set of drop generators 312, a third set of drop generators 314 and a fourth set of drop generators 316 defined in part by the second orifice layer 306 and comprising a second type of drop generator 317 are also shown. Note that the number of drop generators illustrated in FIG. 3 is not reflective of the actual number typically provided; for ease of illustration, the number of drop generators shown has been intentionally minimized. Also note that the first and second orifice layers 304, 306 are preferably separate and apart from each other as defined by a break 307 between the layers. Although the first and second orifice layers 304, 306 may be formed from a single, unitary structure, the break 307 serves to prevent mixing of different ink types, particularly the mixing of cyan, yellow or magenta inks with black ink when the printhead 300 is used to provide multiple colors. Although one set of drop generators 310 of the first type 320 and three sets of drop generators 312–316 of the second type 317 are illustrated, it is understood that varying numbers of drop generator sets of either type could be equally provided as a matter of design choice. For example, in hexachrome applications, six drop generator sets would be provided. Furthermore, although two different types of drop generators 317, 320 are shown, it is possible that a larger number of drop generator types could be employed. Regardless, each set of drop generators are preferably arranged to provide substantially identical degrees of resolution, e.g., 600 dots per inch (dpi) or higher. In practice, a large number of drop generators are grouped in a printhead to provide a print swath of reasonable size such that a swath of text or image can be deposited upon the print medium in one pass of the print carriage across the print medium. Logically, the printhead could be of such a size that a complete page width of ink could be deposited without reciprocal scanning of the printhead. However, in a preferred embodiment, the printhead is on the order 1.25 cm wide thereby requiring reciprocation of the printhead across the medium.

The various types of drop generators 317, 320 are primarily distinguished by the respective drop weights that they are capable of delivering. For the purposes of simplicity, the discussion provided hereinafter focuses on only two types of drop generators with the understanding that the present invention is not necessarily limited to this number. In a preferred embodiment, the different drop weights of the first and second drop generators is a result of the number of nozzles associated with each type. In the embodiment illustrated in FIG. 3, drop generators of the first type comprise two nozzles, whereas drop generators of the second type comprise only a single nozzle. However, the present invention is not limited in this regard; multi-nozzle drop generators may comprise any number of nozzles. Furthermore, the nozzles in a multi-nozzle drop generator are preferably arranged to be as close as possible to each other such that the resultant drops will appear as one when delivered to a suitable medium.

Regardless of the number of nozzles, each drop generator of both types of drop generators functions to provide substantially identical coverage. That is, depending on the ink being used, a single drop fired by a drop generator having a single nozzle provides substantially the same coverage as a drop generator having multiple nozzles. This is possible because, in a preferred embodiment, each nozzle incorporated into the present invention is assumed to be substantially identical to all other nozzles in terms of drop weight capability. Thus, despite that fact that the first set of drop generators actually incorporates twice the number of nozzles as the other sets of drop generators, the resolution provided by the first set will be substantially identical to the other sets. By treating groups of nozzles as a single drop generator, the present invention thereby provides the ability to deliver drops having different drop weights from a single printhead without suffering the limitations of prior art techniques. This is further illustrated with regard to FIG. 4.

Figure 4:
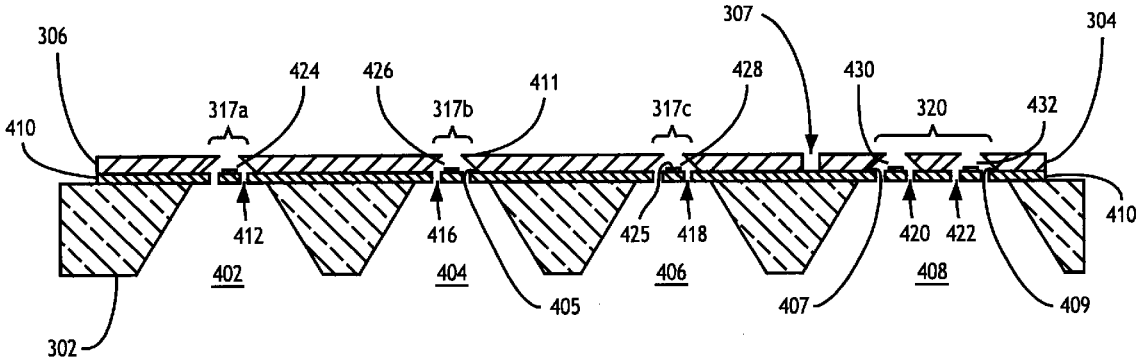
FIG. 4 illustrates a cross-sectional view of the printhead of FIG. 3 along line A—A.

FIG. 4 is a cross-sectional view of the printhead of FIG. 3 taken along line A—A. Structural elements illustrated in FIGS. 3 and 4 have like reference numerals. Note that the dimensions of the structure illustrated in FIG. 4 are not to scale. As shown, the first and second orifice layers 304, 306 rest atop and are secured to a support layer 410, which in turn is affixed to the silicon substrate 302. The support layer 410 is formed of an electrically insulating material such as silicon dioxide, silicon nitride, silicon carbide, tantalum, polysilicon glass or other functionally equivalent material. The support layer 410 also supports ink ejectors 425. Generally, the ink ejectors 425 may comprise any mechanism suitable for ejecting ink from a firing chamber in which ink is delivered to the firing chamber through the floor of the firing chamber. In a preferred embodiment, the ink ejectors 425 comprise thin film heater resistors using conventional deposition techniques as known in the art.

Firing chambers 424–432 are substantially horizontally aligned with the ink ejectors, e.g., the ink ejector having reference numeral 425. Horizontal alignment of the firing chambers 424–432 with the ink ejectors is a matter of design choice and may not be desired in all cases. As known in the art, the firing chambers 424–432 define, in part, the drop weight characteristics of the resulting drop generators. In the context of the present invention, when an ink ejector 425 is activated to expel ink from a firing chamber 424–432, they form an drop generator. As shown, drop generators of the first type 320 comprise at least two firing chambers 430–432 vertically aligned with corresponding ink ejectors. Likewise, drop generators of the second type, e.g., the drop generator having reference numeral 317*b*, comprise a single firing chamber 426 vertically aligned with an ink ejector. Each of the firing chambers 424–432 defines a base periphery and a nozzle orifice, e.g., the base periphery and nozzle orifice having reference numerals 405 and 411, respectively. Note that although the nozzle orifices are shown as being a smaller diameter than he base peripheries for each of the firing chambers 424–432, the present invention is not necessarily limited in this regard. As described below, the ink ejectors associated with each firing chamber of the first type of drop generators 320 are electrically coupled together so that a coordinated ejection of two ink droplets will occur when the drop generator is activated.

Each of the firing chambers 424–432 is also provided with dedicated ink vias 412–422 that provide fluid communication with a respective tapered ink feed trench 402, 404, 406, 408. The ink vias 412–422 are encompassed by the base peripheries so that the ink they supply is exclusively used by their corresponding firing chambers, and so that any pressure generated within a given firing chamber will not cause ink flow to other chambers, except for the limited amount that may flow back through the vias below the upper surface of the substrate. Multiple vias are shown for each firing chamber; this provides redundant ink flow and prevents ink starvation resulting from a single contaminant particle in the ink. In a preferred embodiment, the upper surface of the support layer 410 is patterned and etched to form the vias 412–422 before the orifice layers 304, 306 are attached and before the tapered ink feed trenches 402, 404, 406, 408 are etched into the substrate, as know in the art.

The tapered ink feed trenches 402, 404, 406, 408 (shown in end view) are preferably wider at the lower surface of the substrate 302 to receive ink from an ink reservoir, and taper to a width sufficient to encompass the domain of the ink vias of the associated drop generators 317, 320. Thus, for drop generators of the first type 320, the corresponding trench 408 encompasses the ink vias 420, 422 corresponding to both firing chambers 430, 432. Conversely, for drop generators of the second type 317, the corresponding trenches 402, 404, 406 encompass only the ink vias corresponding to the associated firing chambers 424–428. In all instances, the cross-sectional area of each trench 402, 404, 406, 408 is many times greater than the cross-sectional area of the ink vias associated with the corresponding drop generators 317, 320 so that a plurality of drop generators may be supplied without significant ink flow resistance in the trench.

Fluid ink stored in a reservoir of the cartridge housing 212 flows by capillary force through each trench 402, 404, 406, 408 created in the substrate 302 and through the vias to fill the firing chambers. Each trench is oriented to provide ink to a corresponding set of drop generators, i.e., the first trench 408 provides ink to the first set of drop generators 310 and second through fourth trenches 402, 404, 406 provide ink to the second through fourth sets of drop generators 312–316. In a preferred embodiment, each trench 402, 404, 406, 408 extends to connect to a separate ink storage reservoir for the storage of different colors of ink, such as cyan, yellow, magenta and black, respectively. The substrate 302 is bonded to a cartridge housing surface, which surface therefore defines lower boundaries of the trenches 402, 404, 406, 408.

Nozzle configurations and orientations are design factors that control droplet size, velocity and trajectory of the droplets of ink in the Z-axis (toward the medium being printed upon). The conventional drop generator configuration (i.e., the second type of drop generator) has one orifice and is fired in either a single-drop per pixel or multi-drop per pixel print mode. In the single-drop mode, one ink drop is selectively fired from each nozzle of each of the sets of drop generators 312–316 toward a respective target pixel on the print media. For example, where the sets of drop generators 312–316 provide droplets of cyan, yellow and magenta ink, respectively, a target pixel might get one drop of yellow and magenta from separate nozzles and two drops of cyan from another nozzle in successive scans of the carriage to achieve a desired color hue. In a multi-drop mode, to improve saturation or resolution, two sequential droplets of each of yellow and magenta and four of magenta might be used for a particular hue that might be done on one pass of the carriage. For the purpose of this description, a target pixel is a pixel that a drop generator is traversing as an inkjet printhead is scanned across an adjacent print medium, taking into consideration the physics of directing a drop to a desired location, i.e., the pixel that at which particular drop generator is aiming. The resulting dot on the print media is approximately the same size and color as dots from the same and other nozzles on the same print carriage.

The discussion above regarding single- and multi-drop modes with regard to drop generators of the second type is generally applicable to drop generators of the first type, that is, drop generators having multiple nozzles. For multiple nozzle drop generators, the nozzles preferably operate in a coordinated manner to provide single-pixel coverage at each instance of activation, i.e., to target only a single pixel whenever activated. For example, it is know that black inks typically require about twice the drop weight of colored inks (cyan, yellow and magenta) to provide the same amount of pixel coverage. Thus, the first type of multi-nozzled drop generators when ejecting black ink can provide substantially identical coverage as drop generators of the second type that are ejecting color ink.

As previously mentioned, the ink ejectors track the position of the nozzle orifices. Activation of the ink ejectors is accomplished through the use of electrical connections that act as signal inputs. These electrical connections are typically thin film metallized conductors that electrically connect the ink ejectors on the printhead to contact pads, thence to printhead interface circuitry in the printer. A technique commonly known as "integrated drive head" or IDH multiplexing is conventionally used to reduce electrical interconnections between a printer and its associated print cartridges. Examples of IDH multiplexing may be found in U.S. Pat. No. 5,541,629. In an IDH design, the ink ejectors are arranged into groups known as primitives. Each primitive has its own power supply interconnection (primitive select) and return interconnection (primitive return or primitive common). In addition, a number of control lines (address lines) are use to enable particular ink ejectors. These address lines are shared among all primitives. This approach can be thought of as a matrix where the rows are the number of primitives and the columns are the number of resistors per primitive. The energizing of each ink ejector is controlled by a primitive select and by a transistor such as a MOSFET that acts as a switch connected in series with each resistor. By applying a voltage across one or more primitive selects and the primitive return, and activating the associated gate of a selected transistor, multiple independently addressed ink ejectors may be fired simultaneously. As an alternative approach, so-called smart printheads, in which the printhead deciphers a signal sent from a printer and activates the appropriate ink ejectors, may also be used for this purpose.

Figure 5:
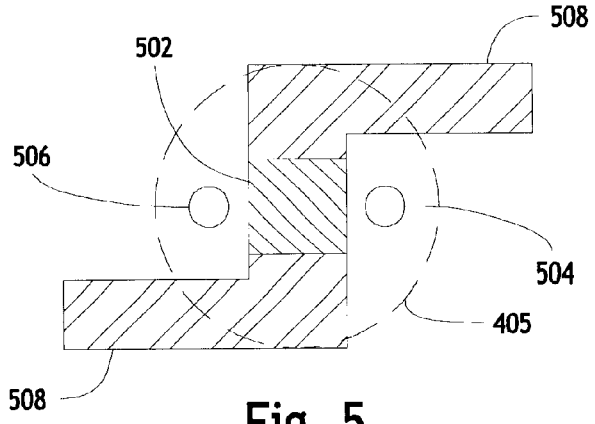
FIG. 5 illustrates a top view of an ink ejector and associated signal paths corresponding to an drop generator of a second type in accordance with the present invention.

The electrical connections described above are further illustrated with regard to FIGS. 5–7. FIG. 5 illustrates a top-down view of an ink ejector (heater resistor) 502 in accordance with the second type of drop generators, i.e., a single nozzle drop generator. The ink vias 504, 506 associated with the ink ejector 502 are also shown. The signal inputs 508 are coupled to the ink ejector 502 such that a signal (voltage) applied across the ink ejector 502 will cause the activation of the ink ejector. An exemplary periphery base 405 is shown in dashed lines to illustrate the manner in which the ink ejector 502 and vias 504, 506 are encompassed by a firing chamber formed in an orifice layer.

Figure 6:
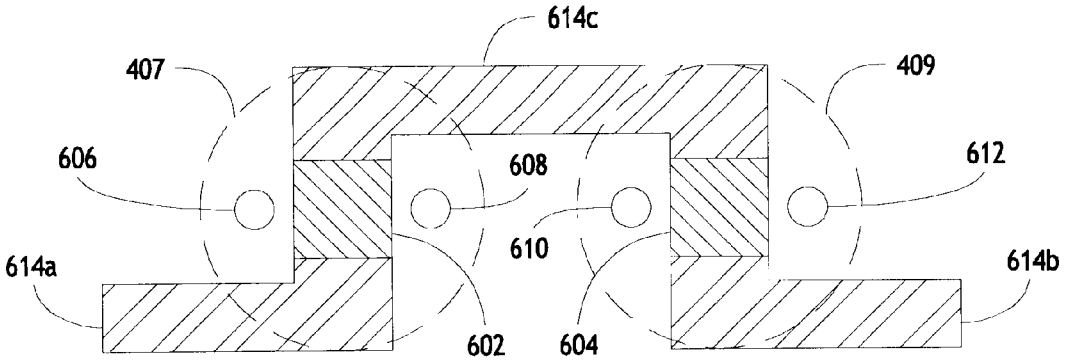
FIG. 6 illustrates a top view of ink ejectors and associated signal paths corresponding to an drop generator of a first type in accordance with the present invention.
Figure 7:
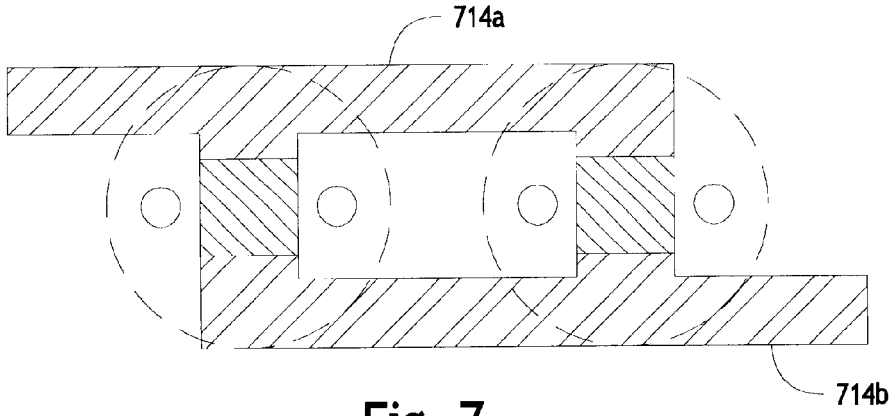
FIG. 7 illustrates a top view of ink ejectors and an alternative arrangement of associated signal paths corresponding to an drop generator of the first type in accordance with the present invention.

FIG. 6 illustrates a top-down view of ink ejectors (heater resistors) 602, 604 in accordance with the first type of drop generators, i.e., a multiple nozzle drop generator. As shown, each of the ink ejectors 602, 604, and its associated vias 606–612, respectively, is encompassed by an exemplary corresponding firing chamber base periphery 407, 409. Series electrical connections 614 are shown such the application of a firing signal across the inputs 614*a*–*b* will cause the ink ejectors 602, 604 to be activated substantially simultaneously. An alternative electrical embodiment achieving substantially the same result is illustrated in FIG. 7. In particular, parallel electrical connections 714 are shown. Again, application of a firing signal across the parallel inputs will cause the ink ejectors to activate substantially simultaneously. The parallel implementation may be preferred when constant voltage is needed across the entire printhead and the parallel implementation has the advantage of providing some redundancy where one of the ink ejectors 602, 604 fails thereby causing a break in the electrical path. As known in the art, other arrangements are possible whereby combinations of ink ejectors are connected in combined serial-parallel fashion. The present invention is not limited in this regard.

Thus, the present invention provides a printhead having multiple types of drop generators, which types are differentiated according to at least the respective drop weights provided by each. As a result, multiple color architectures may be incorporated within a single printhead, thereby providing a competitive advantage. What has been described is merely illustrative of the application of the principles of the present invention. Other arrangements and methods can be implemented by those skilled in the art without departing from the spirit and scope of the present invention.

What is claimed is:

1. An inkjet printhead comprising:

at least a first drop generator set comprising at least one drop generator of a first type, each drop generator of the first type comprising at least two nozzles and at least two ink ejectors associated with the at least two nozzles, and wherein the at least two ink ejectors are driven substantially simultaneously; and at least a second drop generator set comprising at least one drop generator of a second type, wherein each drop generator of the second type is driven independently of the at least one drop generator of the first type.

2. The inkjet printhead of claim 1, further comprising:

at least a third drop generator set comprising at least one drop generator of the second type.

3. The inkjet printhead of claim 1, wherein a first drop weight associated with drop generators of the first type is unequal to a second drop weight associated with drop generators of the second type.

4. The inkjet printhead of claim 3, wherein the first drop weight is a multiple of the second drop weight.

5. The inkjet printhead of claim 1, each drop generator of the first type further comprising:

at least one ink ejector associated with the at least two nozzles; and a signal input operatively coupled to the at least one ink ejector to activate the at least one ink ejector in response to a single firing signal.

6. The inkjet printhead of claim 5, wherein each drop generator of the first type further comprises at least two ink ejectors coupled to the signal input and having a one-to-one association with the at least two nozzles.

7. The inkjet printhead of claim 1, wherein the at least the first drop generator set ejects a first type of ink and the at least the second drop generator set ejects a second type of ink.

8. The inkjet printhead of claim 7, wherein the first type of ink is black ink and the second type of ink is color ink.

9. The inkjet printhead of claim 1, further comprising:

a first orifice layer defining the first drop generator set; and a second orifice layer defining the at least the second drop generator set, wherein the first orifice layer and the second orifice layer are non-unitary.

10. An inkjet cartridge comprising:

a cartridge housing;

at least one internal reservoir of ink within the cartridge housing;

an inkjet printhead, supported by the cartridge housing and in fluid communication with the at least one internal ink reservoir, comprising:

at least a first drop generator set comprising at least one drop generator of a first type, each drop generator of the first type comprising at least two nozzles and at least two ink ejectors associated with the at least two nozzles, and wherein the at least two ink ejectors are driven substantially simultaneously; and at least a second drop generator set comprising at least one drop generator of a second type, wherein each drop generator of the second type is driven independently of the at least one drop generator of the first type.

11. The inkjet cartridge of claim 10, wherein the inkjet printhead further comprises:

at least a third drop generator set comprising at least one drop generator of the second type.

12. The inkjet cartridge of claim 10, wherein a first drop weight associated with drop generators of the first type is unequal to a second drop weight associated with drop generators of the second type.

13. The inkjet cartridge of claim 12, wherein the first drop weight is a multiple of the second drop weight.

14. The inkjet cartridge of claim 10, each drop generator of the first type further comprising:

at least one ink ejector associated with the at least two nozzles; and a signal input operatively coupled to the at least one ink ejector to activate the at least one ink ejector in response to a single firing signal.

15. The inkjet cartridge of claim 14, wherein each drop generator of the first type further comprises at least two ink ejectors coupled to the signal input and having a one-to-one association with the at least two nozzles.

16. The inkjet cartridge of claim 10, wherein the inkjet printhead further comprises:

a first orifice layer defining the first drop generator set; and a second orifice layer defining the at least the second drop generator set, wherein the first orifice layer and the second orifice layer are non-unitary.

17. The inkjet cartridge of claim 10, wherein the at least the first drop generator set ejects a first type of ink from a first internal ink reservoir and the at least the second drop generator set ejects a second type of ink from at least a second internal ink reservoir.

18. An inkjet et printing apparatus comprising:

a printer housing;

a platen with the printer housing and to which in input medium is drawn;

an inkjet printhead, within the printer housing, comprising:

at least a first drop generator set comprising at least one drop generator of a first type, each drop generator of the first type comprising at least two nozzles and at least two ink ejectors associated with the at least two nozzles, and wherein the at least two ink ejectors are driven substantially simultaneously; and at least a second drop generator set comprising at least one drop generator of a second type, wherein each drop generator of the second type is driven independently of the at least one drop generator of the first type.

19. The inkjet printing apparatus of claim 18, wherein the inkjet printhead further comprises:

at least a third drop generator set comprising at least one drop generator of the second type.

20. The inkjet printing apparatus of claim 18, wherein a first drop weight associated with drop generators of the first type is unequal to a second drop weight associated with drop generators of the second type.

21. The inkjet printing apparatus of claim 20, wherein the first drop weight is a multiple of the second drop weight.

22. The inkjet printing apparatus of claim 18, each drop generator of the first type further comprising:

at least one ink ejector associated with the at least two nozzles; and a signal input operatively coupled to the at least one ink ejector to activate the at least one ink ejector in response to a single firing signal.

23. The inkjet printing apparatus of claim 22, wherein each drop generator of the first type further comprises at least two ink ejectors coupled to the signal input and having a one-to-one association with the at least two nozzles.

24. The inkjet printing apparatus of claim 18, wherein the at least the first drop generator set ejects a first type of ink and the at least the second drop generator set ejects a second type of ink.

25. The inkjet printing apparatus of claim 24, wherein the first type of ink is black ink and the second type of ink is color ink.

26. The inkjet printing apparatus of claim 18, wherein the inkjet printhead further comprises:

a first orifice layer defining the first drop generator set; and a second orifice layer defining the at least the second drop generator set, wherein the first orifice layer and the second orifice layer are non-unitary.

27. A method of deposiring ink drops on a medium employing drop generators, the method comprising steps of:

activating at least a first drop generator set comprising at least one drop generator of a first type to deposit a first plurality of ink drops, each drop generator of the first type comprising at least two nozzles and at least two ink ejectors associated with the at least two nozzles, and wherein the at least two ink ejectors are driven substantially simultaneously;

activating at least a second drop generator set comprising at least one drop generator of a second type to deposit a second plurality of ink drops, wherein each drop generator of the second type is driven independently of the at least one drop generator of the first type, and wherein a first drop weight associated with the first plurality of ink drops is a multiple of a second drop weight associated with The second plurality of ink drops.

28. The method of claim 27, further comprising a step of:

activating at least a third drop generator set comprising at least one drop generator of the second type to deposit a third plurality of ink drops.

29. The method of claim 27, wherein the first plurality of ink drops comprise a first type of ink and the second plurality of ink drops comprise a second type of ink.

30. The method of claim 29, wherein the first type of ink is black ink and the second type of ink is color ink.

31. An inkjet printhead comprising:

at least a first drop generator set comprising at least one drop generator of a first type, each of the at least one drop generator of the first type comprising at least two nozzles and at least two ink ejectors associated with the at least two nozzles, wherein the at least two ink ejectors are driven substantially simultaneously; and at least a second drop generator set comprising at least one drop generator of a second type, wherein each of the at least one drop generator of the second type is driven independently of the at least one drop generator of the first type.

32. An inkjet cartridge comprising:

a cartridge housing;

at least one internal reservoir of ink within the cartridge housing;

an inkjet printhead, supported by the cartridge housing and in fluid communication with the at least one internal ink reservoir, comprising:

at least a first drop generator set comprising at least one drop generator of a first type, each of the at least one drop generator of the first type comprising at least two nozzles and at least two ink ejectors associated with the at least two nozzles, wherein the at least two ink ejectors are driven substantially simultaneously; and at least a second drop generator set comprising at least one drop generator of a second type, wherein each of the at least one drop generator of the second type is driven independently of the at least one drop generator of the first type.

33. An inkjet printing apparatus comprising:

a printer housing;

a platen within the printer housing and to which an input medium is drawn;

an inkjet printhead, within the printer housing, comprising:

at least a first drop generator set comprising at least one drop generator of a first type, each of the at least one drop generator of the first type comprising at least two nozzles and at least two ink ejectors associated with the at least two nozzles, wherein the at least two ink ejectors are driven substantially simultaneously; and at least a second drop generator set comprising at least one drop generator of a second type, wherein each of the at least one drop generator of the second type is driven independently of the at least one drop generator of the first type.

34. A method of depositing ink drops on a medium employing drop generators, the method comprising steps of:

activating at least a first drop generator set comprising at least one drop generator of a first type to deposit a first plurality of ink drops, each drop generator of the first type comprising at least two nozzles and at least two ink ejectors associated with the at least two nozzles, and wherein the at least two ink ejectors are driven substantially simultaneously; and activating at least a second drop generator set comprising at least one drop generator of a second type to deposit a second plurality of ink drops wherein each drop generator of the second type is driven independently of the at least one drop generator of the first type.

* * * * *

UNITED STATES PATENT AND TRADEMARK OFFICE

CERTIFICATE OF CORRECTION

PATENT NO. : 6,328,405 B1
DATED : December 11, 2001
INVENTOR(S) : Timothy L. Weber et al.

It is certified that error appears in the above-identified patent and that said Letters Patent is hereby corrected as shown below:

Column 9,
Line 44, "inkjet et" should read -- inkjet --;

Column 10,
Line 31, "deposiring" should read -- depositing --.

Signed and Sealed this

Eighteenth Day of February, 2003

JAMES E. ROGAN
*Director of the United States Patent and Trademark Office*